US011769973B2

(12) United States Patent
Kirschner

(10) Patent No.: US 11,769,973 B2
(45) Date of Patent: Sep. 26, 2023

(54) PLUG CONNECTOR AND PLUG CONNECTOR ASSEMBLY

(71) Applicant: MD ELEKTRONIK GmbH, Waldkraiburg (DE)

(72) Inventor: Thomas Kirschner, Muehldorf am Inn (DE)

(73) Assignee: MD ELEKTRONIK GMBH, Waldkraiburg (DE)

( * ) Notice: Subject to any disclaimer, the term of this patent is extended or adjusted under 35 U.S.C. 154(b) by 39 days.

(21) Appl. No.: 17/578,495

(22) Filed: Jan. 19, 2022

(65) Prior Publication Data

US 2022/0239044 A1 Jul. 28, 2022

(30) Foreign Application Priority Data

Jan. 28, 2021 (DE) ..... 20 2021 100 405.3

(51) Int. Cl.
*H01R 24/54* (2011.01)
*H01R 103/00* (2006.01)

(52) U.S. Cl.
CPC ..... *H01R 24/542* (2013.01); *H01R 2103/00* (2013.01); *H01R 2201/26* (2013.01)

(58) Field of Classification Search
CPC ..... H01R 2103/00; H01R 13/4223; H01R 13/113; H01R 9/0518; H01R 24/542; H01R 2201/26
USPC ..... 439/578, 752.5
See application file for complete search history.

(56) References Cited

U.S. PATENT DOCUMENTS

| | | | | |
|---|---|---|---|---|
| 3,406,373 | A | 10/1968 | Forney, Jr. | |
| 3,601,783 | A | 8/1971 | Loose | |
| 8,388,388 | B2 * | 3/2013 | Suzuki | H01R 13/113 439/752.5 |
| 10,446,951 | B2 | 10/2019 | Miedl | |
| 10,553,977 | B2 | 2/2020 | Pemwieser et al. | |
| 2009/0247009 | A1 | 10/2009 | Yoshida | |

FOREIGN PATENT DOCUMENTS

| | | | |
|---|---|---|---|
| DE | 102016002408 | A1 | 8/2017 |
| DE | 102016109266 | A1 | 11/2017 |
| WO | WO 2020129624 | A1 | 6/2020 |

* cited by examiner

*Primary Examiner* — Gary F Paumen
(74) *Attorney, Agent, or Firm* — LEYDIG, VOIT & MAYER, LTD.

(57) ABSTRACT

A plug connector for transmitting high-frequency signals includes a cable, a contact and a connecting element. The cable has a free end. The contact is mounted on the free end of the cable, and has a free contact end on a side facing away from the cable. The connecting element is disposed between the contact and the cable, and, in an assembled state, is fixedly connected to the contact and to the cable. The connecting element has a first portion with a first outer diameter on a side facing the contact and a second portion with a second outer diameter on a side facing the cable, the second outer diameter being larger than the first outer diameter. The first portion includes a third portion that has, at least in some regions of the third portion, an outer diameter corresponding to the second outer diameter.

14 Claims, 7 Drawing Sheets

PLUG CONNECTOR AND PLUG CONNECTOR ASSEMBLY

CROSS REFERENCE TO RELATED APPLICATIONS

This application claims benefit to German Patent Application No. DE 20 2021 100 405.3, filed on Jan. 28, 2021, which is hereby incorporated by reference herein.

FIELD

The present invention relates to a plug connector for transmitting high-frequency or radio-frequency signals, in particular in a vehicle, and to a plug connector assembly.

BACKGROUND

In a vehicle, various technical components communicate with each other by exchanging data. The data exchange preferably takes place in the form of high-frequency signals passed through suitable cables, such as coaxial cables or micro-coaxial cables. Often, plug connectors are used at interfaces between cables and/or technical components. To facilitate handling in automotive applications, plug connectors are generally standardized; i.e., certain dimensions and sizes of a plug connector are predetermined and must be observed. The requirements are essentially directed to the durability and releasability of the plug connector and to reliable data transmission. However, the standardized dimensions can lead to difficulties during the assembly of connector components, for example when parts are not always fully visible or when excessive play occurs between parts during assembly.

German Publication DE 10 2016 002 408 A1 relates to a coaxial plug-and-socket connection and a connection system including this plug-and-socket connection. In addition to a first contact junction between a first coaxial connector and a matching second coaxial connector, a second contact junction is implemented in the plug-and-socket connection in the outer conductor portion thereof. To this end, an elastic contact component is provided between the first coaxial connector and the second coaxial connector at a distance from the first contact junction, in particular at a distance from the first latching means. The elastic contact component preferably takes the form of a toroidally wound ring. The toroidally wound wire of the ring is elastic both radially and axially and bridges different distances between a coaxial socket and a coaxial plug, which can occur depending on a respective radial offset between the coaxial plug and the coaxial socket. In the case of a radial offset, the axis of the connecting element and the axis of a coaxial socket form a certain angle other than zero.

However, due to the elasticity of the contact component, the occurrence of a radial offset (i.e., tilting) cannot be ruled out, neither during insertion nor during arrangement of the two connectors within each other. This may lead to further inaccuracies during assembly. Furthermore, the contact component must be disposed as a separate part on a connector, which increases complexity. Finally, the contact component must be configured and mounted such that it is able to withstand the high mechanical dynamics occurring in a vehicle at least over a predetermined lifetime, which is associated with additional effort.

SUMMARY

In an embodiment, the present invention provides a plug connector for transmitting high-frequency signals that includes a cable, a contact and a connecting element. The cable has at least one free end. The contact is mounted on the at least one free end of the cable, and has a free contact end on a side facing away from the cable. The connecting element is disposed between the contact and the cable, and, in an assembled state, is fixedly connected to the contact and to the cable. The connecting element has at least a first portion with a first outer diameter on a side facing the contact and a second portion with a second outer diameter on a side facing the cable, the second outer diameter being larger than the first outer diameter. The first portion includes at least a third portion that has, at least in some regions of the third portion, an outer diameter corresponding to the second outer diameter.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
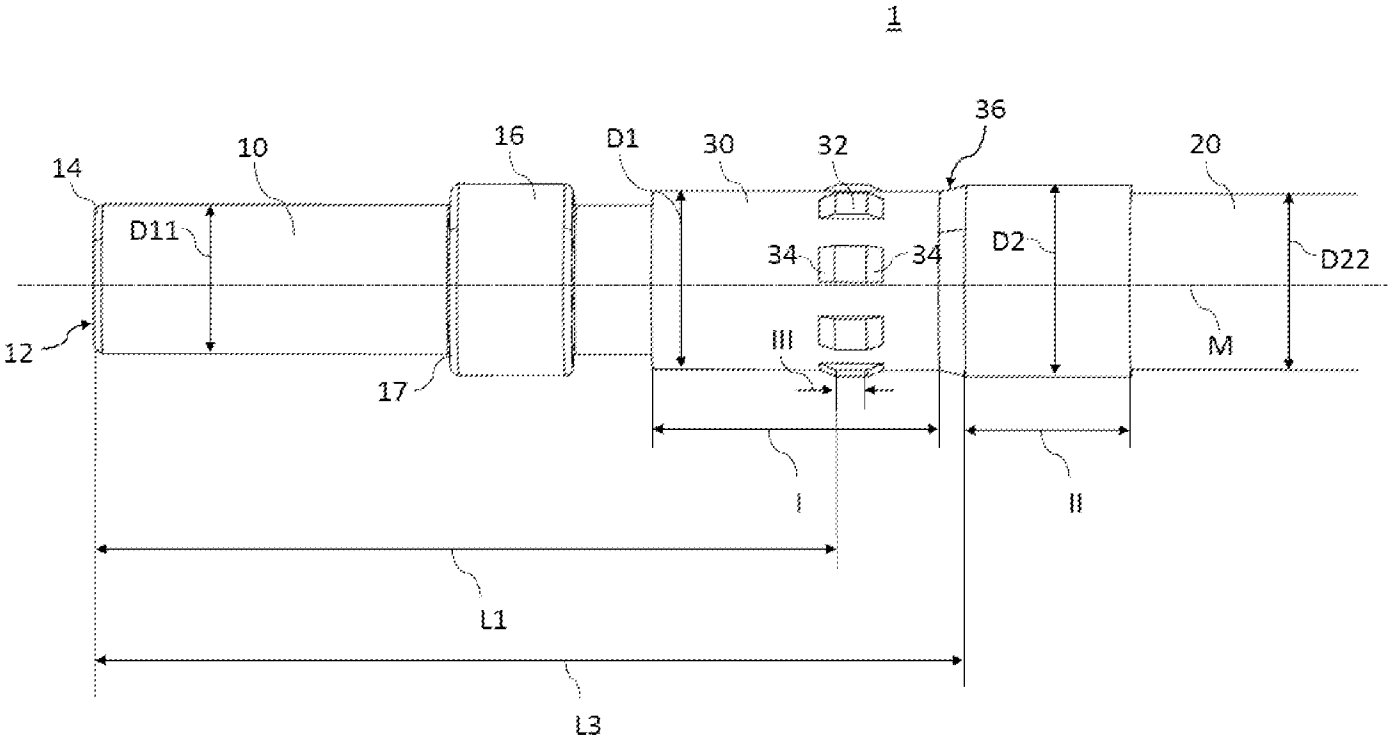
FIG. 1 is a side view of an embodiment of a plug connector.

Embodiments of the present invention provide a plug connector for transmitting high-frequency signals as well as a plug connector assembly which are simple and rugged in construction, meet the required standards, and enable quick and reliable assembly.

In particular, a plug connector that is simple and rugged in construction, meets the required standards, and enables quick and reliable assembly is achieved by a plug connector for transmitting high-frequency signals according to an embodiment of the present invention. The plug connector has a cable having at least one free end, as well as a contact mounted on the free cable end and having a free contact end on a side facing away from the cable, and further has a connecting element which is disposed between the contact and the cable and which, in the assembled state, is fixedly connected to the contact and to the cable. The connecting element has at least a first portion with a first outer diameter on a side facing the contact and at least a second portion with a second outer diameter on a side facing the cable, the second outer diameter being larger than the first outer diameter. Finally, the first portion includes at least a third portion, the connecting element at least in some regions of the third portion having an outer diameter corresponding to the second outer diameter.

The plug connector allows the cable to be connected to a terminal that is complementary to the contact. The cable is preferably a coaxial cable or a micro-coaxial cable, and the terminal is preferably a corresponding coaxial connector. Via the plug connector, high-frequency signals can be transmitted in a vehicle. The plug connector may also be used for other types of cables. The line groups mounted in the plug connector are preferably of the common low loss (LL) and radio guide (RG) types, which differ in their diameter or dimensioning. Due to these differences, a variation in diameter may occur along the connecting element during the assembly of a plug connector, especially during the crimping of the connecting element.

The dimensioning of a housing for receiving at least one plug connector; i.e., also the dimensioning of at least one plug connector receptacle, is essentially strictly defined. In accordance with the defined dimensioning, the at least one plug connector receptacle has a uniform cylindrical shape. In the uniform cylindrical shape, the above-described variation in diameter of the connecting element leads to a variation in the joining situation in the plug connector receptacle, and thus to play between the peripheral wall of the plug connector receptacle and at least a first portion of the connecting element, which first portion has a smaller diameter. Such play may result in tilting of the plug connector and difficulties during assembly. In particular, when the plug connector is inserted at an angle, it is likely to collide with a push-through guard in the housing.

An embodiment of the present invention is intended to compensate for variations in diameter so as to ensure a uniform joining situation without impairing the mechanical and electrical properties of the plug connector. In a certain area, the diameter is, at least in some regions, increased by an embossed formation, preferably a bump or projection. This makes it possible to reduce or prevent the occurrence of (wobbling) play during fitting of the plug connector into the housing. For this purpose, the first portion of the connecting element, which has a smaller outer diameter than a second portion, includes a third portion which has an outer diameter corresponding to the second outer diameter at least in some regions in the circumferential direction of the connecting element.

During insertion of the plug connector into the housing, the plug connector is inserted with the free end of the contact forward into the housing. Since the first portion, and thus also the third portion, is disposed on a side facing the free contact end, the third portion enters the housing before the second portion. Furthermore, the plug connector can be inserted unhindered into the housing up to the third portion, preferably up to the beginning of the third portion, as viewed from the free contact end. The mentioned push-through guard is further away. With the insertion of the third portion, the plug connector can be accurately aligned with the housing or the plug connector receptacle in the housing. In this process, the third portion is visible from the outside and disappears from the field of view as it is inserted into the housing. The visibility simplifies the alignment and thus the assembly process.

Preferably, an outer diameter of the contact is smaller than an outer diameter of the cable. The dimensioning of the contact and of the cable is predetermined. To allow for a space-saving arrangement and connection, the contact typically has a smaller diameter than the cable.

In the assembled state, the connecting element preferably directly embraces the contact and the cable in its first and second portions, respectively. The direct and snug joining ensures a space-saving and reliable connection. The direct joining preferably includes crimping of the connecting element so that the contact and the cable are frictionally connected together. Because the contact and the cable have different outer diameters, different outer diameters are formed along the connecting element as it is directly embraced.

Preferably, the connecting element includes a compression sleeve such as a crimp sleeve or a compression tube. A compression or crimp sleeve is a standard component and is simple and cost-effective to use. The compression or crimp sleeve is preferably formed from a metal. The compression or crimp sleeve can be readily connected to the contact and the cable, in particular using a compression tool. In particular, the third portion may be formed during the compression operation. Preferably, the compressing is performed using a star-type compression tool since this tool allows for an even distribution of compression force or pressure.

Preferably, the third portion has a plurality of embossed formations formed in spaced-apart relationship on the periphery of the connecting element. The embossed formations preferably include projections. The number of embossed formations around the circumference may be defined by the required pull-off strength. The embossed formations can readily be produced or formed into the connecting element during a compression operation. In particular, no additional steps or fastening means are required for the embossed formations. The plurality of embossed formations are arranged such that there is at least one section of the third portion that has an outer diameter corresponding to the second outer diameter. Preferably, the embossed formations are arranged in diametrically opposite pairs on the periphery of the connecting element.

Preferably, the embossed formations are integral with the connecting element. The connecting element preferably includes a dimensionally stable material, in particular metal. Because the embossed formations are formed integrally from the connecting element, the embossed formations are also composed of the dimensionally stable material of the connecting element. Thus, the embossed formations cannot be compressed or bent during assembly without a separate compression tool. Because of this, the plug connector can at all times be reliably inserted into the housing without unwanted play.

Preferably, guide elements are disposed at the embossed formations in the transitions between the first portion and the third portion. Due to their shape, the guide elements facilitate the insertion of the plug connector into the receiving opening of the housing. This simplifies assembly.

Preferably, a distance between the free contact end and the third portion is smaller than a distance between the free contact end and the second portion. This means that the third portion is located closer to the free contact end. The plug connector is inserted with its free contact end first into the housing. Consequently, the third portion reaches or enters the housing before the second portion. The plug connector is aligned with the housing as early as when the third portion is inserted.

A plug connector assembly that is simple and rugged in construction, meets the required standards, and enables quick and reliable assembly is also achieved in particular by a plug connector assembly for at least one plug connector for transmitting high-frequency signals according to an embodiment of the present invention. The plug connector assembly has at least one plug connector and a housing with at least one plug connector receptacle for disposing the at least one plug connector in the housing. The at least one plug connector receptacle has an inner diameter corresponding to the second outer diameter of the connecting element and a length corresponding to at least a distance between the free contact end and the third portion.

The plug connector assembly preferably has a plurality of plug connector receptacles. This allows a plurality of plug connectors to be connected simultaneously to complementary terminals. The housing protects the connectors from the outside environment. In addition, the housing provides latching features for a reliable connection between a plug connector and a complementary terminal. Preferably, in the assembled state, the respective plug connector and the housing are also in engagement with one another, in particular via latching means. The housing and a plug connector receptacle respectively have a predefined fixed length in the longitudinal direction of the cable. In particular, the length is selected such that a plug connector is securely disposed in the housing. The length of the plug connector receptacle may in particular be a multiple of a diameter of a receiving opening, so that an end of the plug connector receptacle opposite the receiving opening is only visible when viewed in a direction along the plug connector receptacle.

Preferably, the plug connector assembly further has a push-through opening with a push-through guard, the push-through opening having a diameter corresponding to the outer diameter of the contact. The push-through opening is surrounded by the push-through guard. The push-through guard forms in particular a wall. In order for a plug connector to reach its final position within the housing, the contact of the plug connector must be pushed through the push-through opening. Since the diameter of the push-through opening corresponds exactly to the outer diameter of the contact, the plug connector must be accurately aligned within the housing and, in particular, along receptacle axis A in order to move the plug connector through the push-through opening. Accurate alignment is important inter alia for reliable connection to a terminal connectable to the contact.

In addition, further advantages and features of embodiments of the present invention will be apparent from the following description of preferred embodiments. The features described therein and hereinabove may be implemented alone or in combination, unless they contradict each other. The following description of the preferred embodiments is made with reference to the accompanying drawings.

FIG. 1 shows an embodiment of a plug connector 1 in a side view along a central axis M. Plug connector 1 has a contact 10, a cable 20, and a connecting element 30. Connecting element 30 is configured as a hollow cylinder and surrounds an end of contact 10 and an end of cable 20. Preferably, contact 10 and cable 20 abut against each other within connecting element 30. Due to the abutment between contact 10 and cable 20, electrical signals, in particular high-frequency signals, can be transmitted in both directions. Contact 10 preferably has an inner conductor 13 and an outer conductor 15 annularly surrounding inner conductor 13 (see FIG. 5). At contact 10, the high-frequency signals are preferably transmitted via inner conductor 13. Outer conductor 15 preferably serves as a shield for inner conductor 13. In the assembled state, connecting element 30 is fixedly, in particular permanently, connected to contact 10 and cable 20, holding contact 10 and cable 20 together.

Contact 10, also referred to as a cable output, is connectable to a terminal complementary to contact 10, so that signals can be exchanged between cable 20 and the complementary terminal via plug connector 1. The dimensions of contact 10 for connection to the complementary terminal are predetermined. In particular, contact 10 has a predetermined length. Contact 10 further has an outer diameter D11. In the embodiment shown in FIG. 1, contact 10 further has a sleeve 16 having a front edge 17. Front edge 17 faces toward a free end 12 of contact 10. Free end 12 of contact 10 has an edge 14. Edge 14 preferably forms part of outer conductor 15 of contact 10. Therefore, edge 14 is in particular annular. In a preferred embodiment, edge 14 has a shape that tapers toward free end 12. The tapered shape facilitates the connection of a terminal that is complementary and connectable to contact 10 and/or the insertion of contact 10 through a push-through opening 58 in a housing 50 of a plug connector assembly 40 (see FIG. 3).

Cable 20 is preferably a coaxial cable or micro-coaxial cable for transmission of high-frequency signals. In other embodiments, other types of cables may also be used. Cable 20 has an outer diameter D22. Outer diameter D22 is preferably larger than outer diameter D11 of contact 10.

Connecting element 30 is preferably a crimp sleeve or a compression tube. Connecting element 30 is preferably compressible so that it permanently surrounds an inserted contact and/or a cable as it is compressed or crimped. In the embodiment shown in FIG. 1, connecting element 30 has at least a first and a second portion I, II.

First portion I is located on a side facing contact 10. First portion I surrounds an end of contact 10 directly, snugly, and firmly. Second portion II is located on a side facing cable 20. Second portion II surrounds an end of cable 20 directly, snugly, and firmly. Since outer diameter D11 of contact 10 is preferably smaller than outer diameter D22 of cable 20, the first outer diameter D1 of connecting element 30 in first portion I is smaller than the second outer diameter D2 of connecting element 30 in second portion II. In particular, second outer diameter D2 of connecting element 30 corresponds to a maximum outer diameter in the assembled state; i.e., after compression. The maximum outer diameter is preferably in the range of 2-5 mm, more preferably in the range of 2.5-4 mm, even more preferably in the range of 3-3.5 mm. These and all other dimensions can be scaled as desired to other plug connectors.

Second portion II is spaced from free end 12 of contact 10 by a minimum distance L3. Between first portion I and second portion II, there may be provided a transition section 36 in which the outer diameter of connecting element 30 increases from first outer diameter D1 to second outer diameter D2, proceeding from the side facing contact 10.

First portion I has a third portion III, the third portion III being preferably shorter than first portion I and preferably spaced apart from second portion II and from transition section 36. Third portion III preferably has a length in the range of 0.3-1 mm, more preferably in the range of 0.4-0.8 mm, even more preferably in the range of 0.5-0.6 mm. Third portion III is spaced from free end 12 of contact 10 by a minimum distance L1. Distance L1 is preferably smaller than distance L3. Distance L1 is preferably in the range of 12-18 mm, more preferably in the range of 13-16 mm, even more preferably in the range of 14-15 mm.

Third portion III is preferably an annular or cylindrical portion along connecting element 30. Third portion III has in particular at least one embossed formation 32 disposed therein. In the case of a single embossed formation 32, embossed formation 32 preferably extends over more than half the circumference. In an alternate embodiment, embossed formation 32 may also extend over the entire circumference. Preferably, third portion III has a plurality of embossed formations 32. A plurality means two or more embossed formations. The plurality of embossed formations 32 are preferably spaced apart along the circumference of connecting element 30, so that in at least a sub-region of third portion III, the outer diameter of connecting element 30 corresponds to second outer diameter D2 of connecting element 30. For this purpose, in particular, at least two embossed formations 32 are arranged on diametrically opposite sides of the periphery of connecting element 30.

Preferably, guide elements 34 are disposed at the transitions of the at least one embossed formation 32 between the first and the third portions I, III. In the embodiment shown, guide elements 34 have an inclined plane and are disposed on both sides of each embossed formation 32. In other embodiments, guide elements 34 may have other shapes such as curved planes, stepped shapes, rounded edges, etc. Furthermore, in other embodiments, guide elements 34 may be disposed only on the side facing contact 10. Guide elements 34 serve to facilitate the insertion of plug connector 1 with connecting element 30 into a plug connector receptacle 52 of a housing 50 (see FIG. 2-FIG. 5). The region or regions along central axis M of plug connector 1 where guide elements 34 are disposed may form a separate portion because there the outer diameter is larger than first outer diameter D1 and smaller than second outer diameter D2 of connecting element 30. Guide elements 34 may be formed together with the embossed formations 32, in particular during a compression operation. Preferably, guide elements 34 are integral with connecting element 30.

FIG. 2 through FIG. 5 show a plug connector assembly 40 having a housing 50 and a plug connector 1 being inserted into housing 50. In the embodiment shown, housing 50 has a total of four plug connector receptacles 52, in each of which may be disposed a plug connector 1. Each plug connector receptacle 52 may be identical in design, and a plurality of plug connector receptacles 52 may also be arranged differently than shown in FIG. 2 through FIG. 5. For example, they may all be arranged side by side in a housing 50.

In order for a plug connector 1 to be received in one of plug connector receptacles 52, central axis M of plug connector 1 is aligned with the corresponding receptacle axis A. Then, plug connector 1 is inserted with the free end 12 of its contact 10 forward through receiving opening 54 into plug connector receptacle 52. Diameter D4 of plug connector receptacle 52 and receiving opening 54 preferably corresponds to the maximum outer diameter of plug connector 1; i.e., to second outer diameter D2 in second portion II of connecting element 30. Thus, plug connector 1 can be completely inserted into housing 50 and plug connector receptacle 52 and is finally seated.

A push-through opening 58 is disposed opposite each receiving opening 54. Receptacle axis A extends centrally through plug connector receptacle 52 and push-through opening 58. Each push-through opening 58 is surrounded by a push-through guard 56, which determines inner diameter D3 of push-through opening 58. Push-through guard 56 is in particular a wall. Inner diameter D3 of push-through opening 58 corresponds to outer diameter D11 of contact 10. Plug connector 1 can be pushed through push-through opening 58 up to a sleeve edge 17 of sleeve 16. When sleeve edge 17 abuts against push-through guard 56, plug connector 1 has reached its optimal end position within housing 50. Connector 1 is fixed in its end position by locking means.

Figure 2:
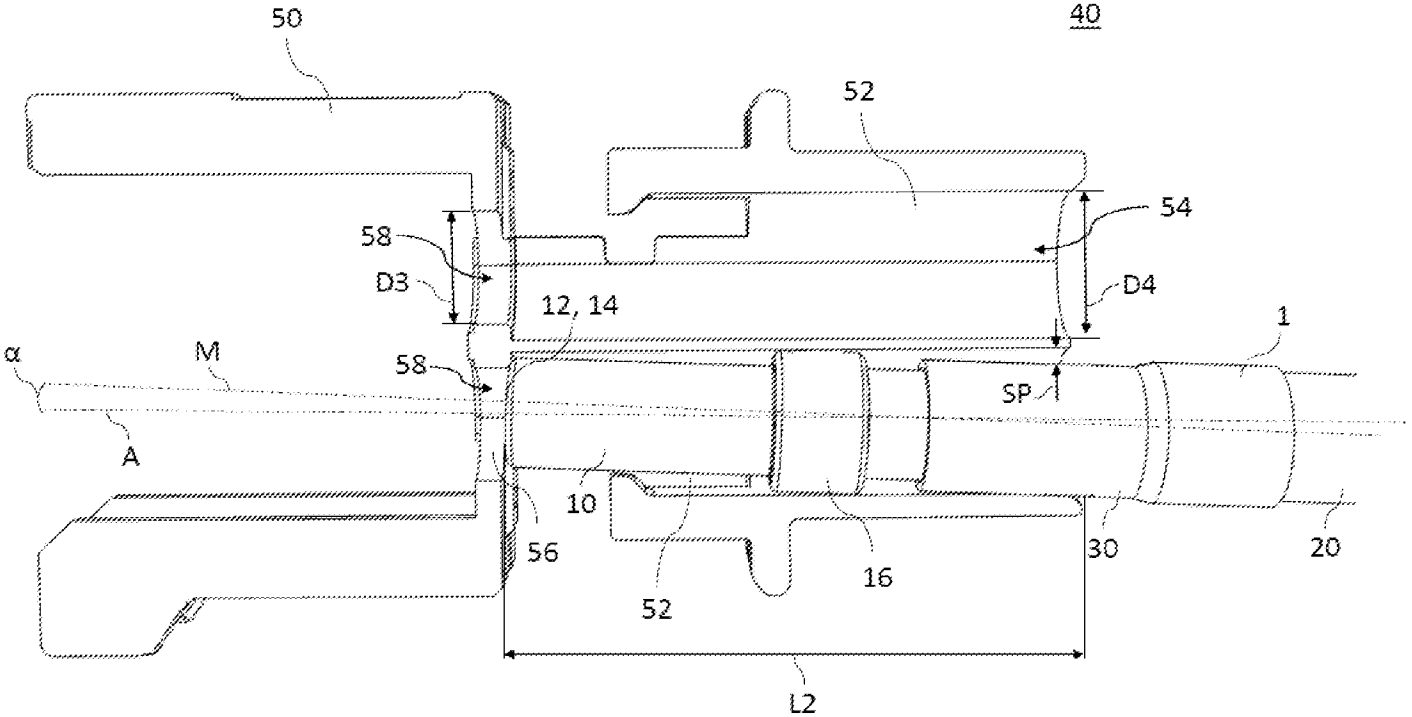
FIG. 2 is a side view of an embodiment of a plug connector assembly with a plug connector having a connecting element without embossed formations.

Furthermore, FIG. 2 shows a plug connector 1 which has no embossed formations 32 on connecting element 30. Outer diameter D11 of contact 10 and first outer diameter D1 in the first portion of connecting element 30 are smaller than inner diameter D4 of receiving opening 54 and plug connector receptacle 52. Due to the difference in diameter, a clearance is formed between plug connector 1 and the peripheral walls of plug connector receptacle 52. This clearance provides for some play SP during insertion of plug connector 1 into plug connector receptacle 52, whereby plug connector 1 can not only be moved along plug connector receptacle 52, but can also be moved, in particular tilted, transversely to plug connector receptacle 52. Due to the tilting, central axis M of plug connector 1 and receptacle axis A of plug connector receptacle 52 no longer coincide.

Push-through guard 56 is generally disposed in housing 50 in such a way that it is only visible when viewing in a direction along receptacle axis A. However, when inserting plug connector 1 into housing 50, assembly personnel cannot move plug connector 1 along receptacle axis A and at the same time look along this axis A. When plug connector 1 and central axis M are tilted by an angle $\alpha$ with respect to receptacle axis A, free end 12 of contact 10 abuts against push-through guard 56 in a sub-region of edge 14 of free end 12. This means that when plug connector 1 is in a tilted condition, it cannot be inserted further into plug connector receptacle 52 and housing 50. Plug connector 1 does not reach its optimal end position and is not locked in place. The assembly personnel can only tilt plug connector 1 back and forth to change the angle of inclination a in an attempt to push free end 12 of contact 10 through push-through opening 58. This manner of assembly is time-consuming and frustrating. In addition, components may be damaged if haptic feedback upon abutment is the only way of determining whether plug connector 1 is correctly aligned in plug connector receptacle 52.

Figure 3:
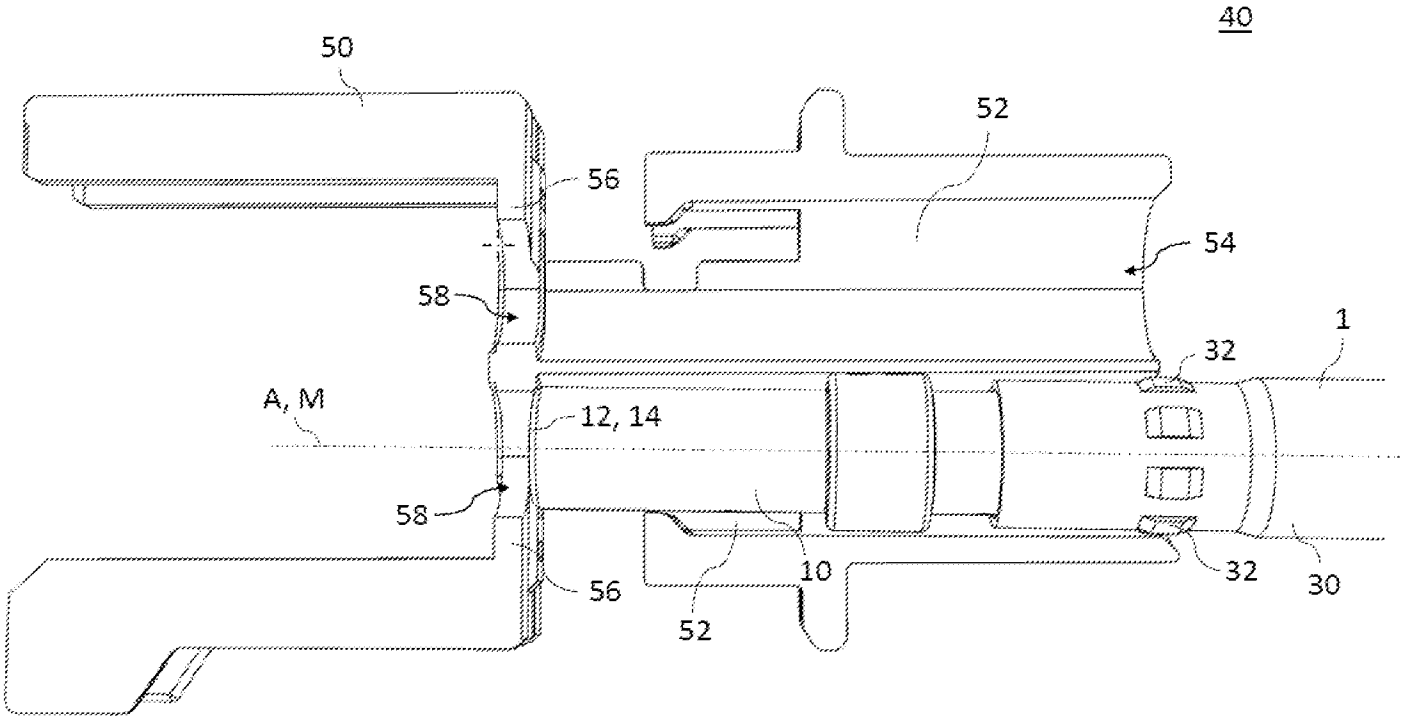
FIG. 3 is a view of the plug connector assembly of FIG. 2 with a plug connector having a connecting element with embossed formations, shown during assembly.

FIG. 3 shows a plug connector 1 having a connecting element 30 with embossed formations 32. As a result of the embossed formations 32, the outer diameter of plug connector 1 at least in some regions in third portion III of connecting element 30 corresponds to second outer diameter D2 in second portion II. Distance L1 between free end 12 of contact 10 and third portion III corresponds to distance L2 between push-through opening 58 or push-through guard 56 and receiving opening 54. In an alternative embodiment, distance L1 may also be smaller than distance L2. In the case of a distance L1 smaller than or equal to distance L2, third portion III of connecting element 30 reaches receiving opening 54 before or at the same time as free end 12 of contact 10 abuts against push-through guard 54. In order to push plug connector 1 further into housing 50, third portion III, which the assembly personnel can see from outside, must be correctly aligned with receiving opening 54. "Correctly aligned" means that central axis M coincides with receptacle axis A. By bringing the two axes A, M into coincidence, free end 12 of contact 10 is also aligned centrally with respect to push-through opening 58. By moving plug connector 1 along axes A, M, it can be brought into its end position in housing 50. Because third portion III is visible from the outside during insertion into the receiving opening 54, the assembly personnel can visually recognize proper alignment and readjust it if necessary. There is no need to tilt plug connector 1 back and forth in housing 50.

Figure 4:
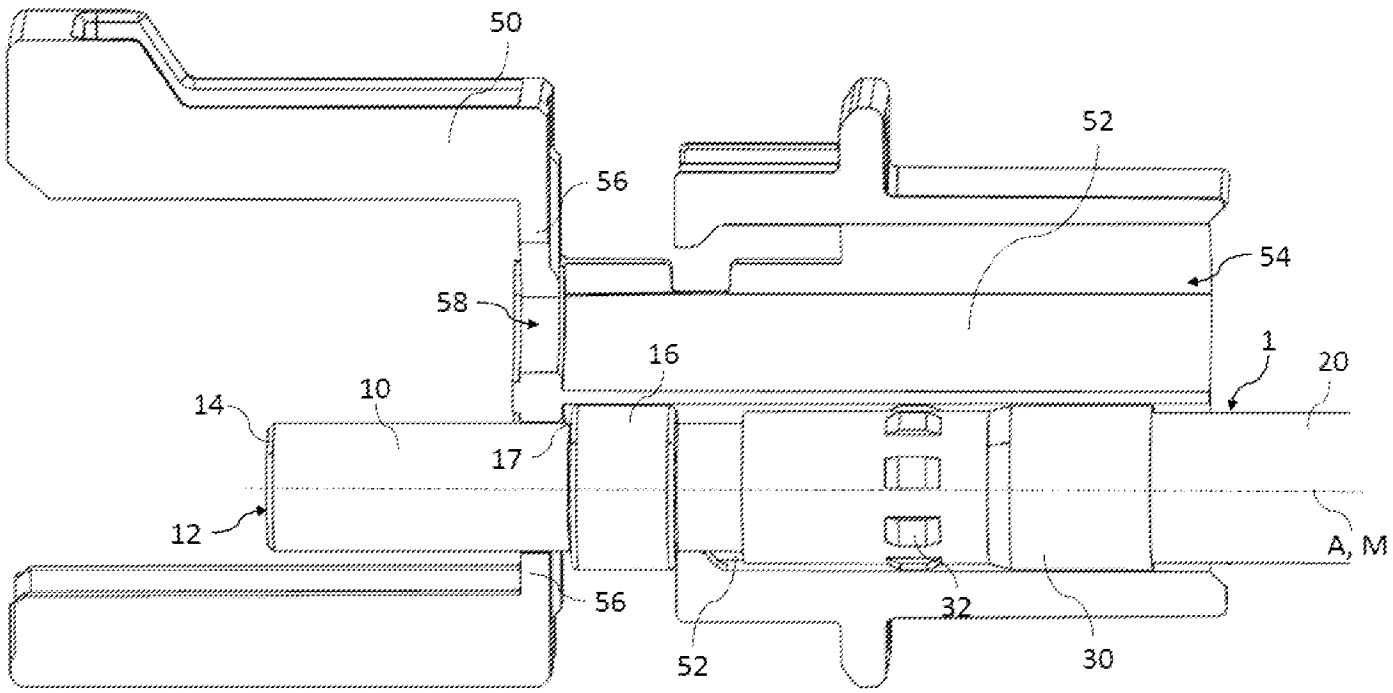
FIG. 4 is a view showing the plug connector assembly of FIG. 3 in the assembled state.
Figure 5:
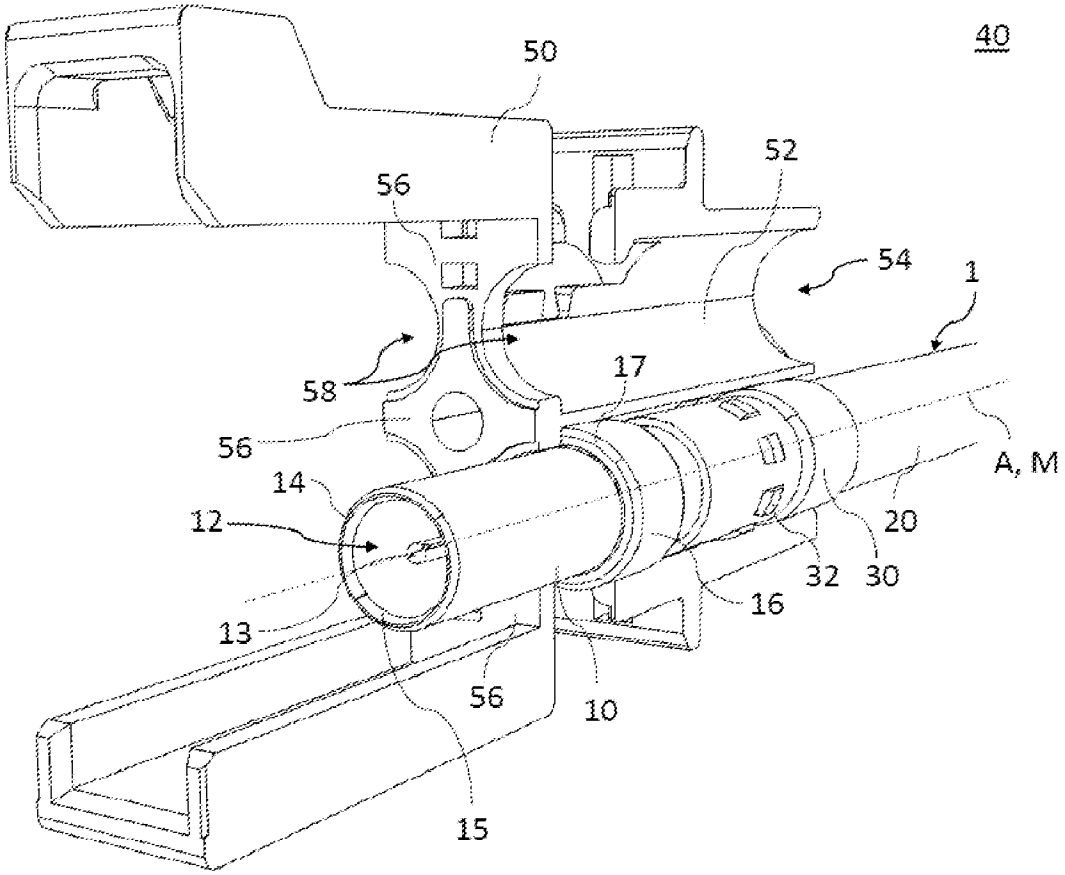
FIG. 5 is a perspective view of the plug connector assembly of FIG. 4.

FIG. 4 and FIG. 5 show plug connector 1 in its end position in housing 50. Contact 10 is inserted through push-through opening 58 up to the point where sleeve edge 17 of sleeve 16 abuts against push-through guard 56. Contact 10 protrudes out of push-through opening 58 to the maximum possible extent on a side opposite the plug connector receptacle 52 so that contact 10 can be connected to a complementary terminal. Furthermore, plug connector 1, together with connecting element 30, is inserted as far as possible into plug connector receptacle 52 and locked in place therein. This provides protection for plug connector 1 and connecting element 30 in housing 50 and ensures a reliable connection. Due to the embossed formations 32 in third portion III, plug connector 1 has additional points of radial contact with the inner surface of plug connector receptacle 52, which improves the positioning of plug connector 1 in plug connector receptacle 52.

Figure 6A:
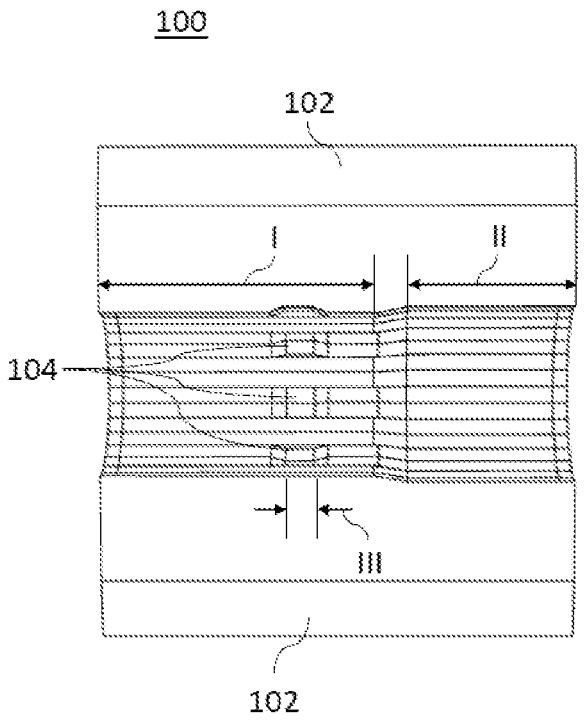
FIGS. 6*a* and 6*b* are a side view (FIG. 6*a*) and a perspective view (FIG. 6*b*) of a star-type compression tool for producing embossed formations on the connecting element.
Figure 6B:
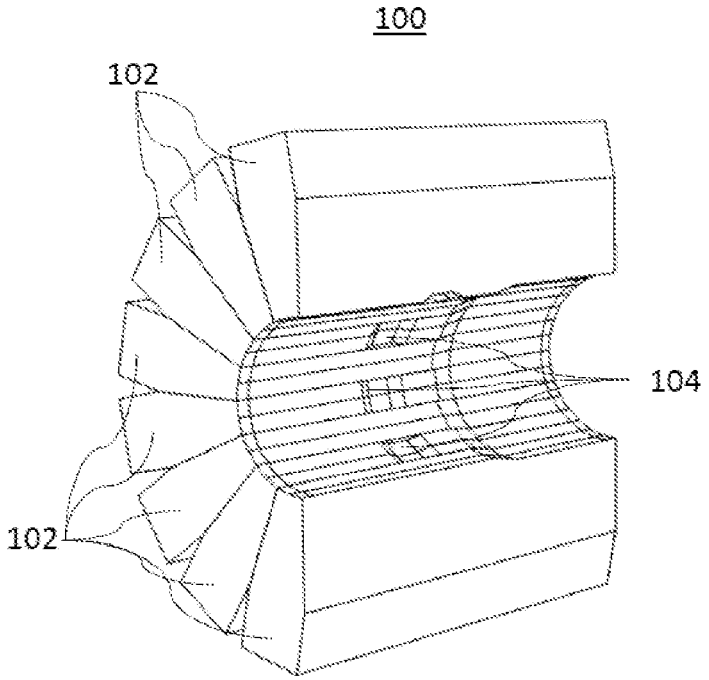
Figure 7:
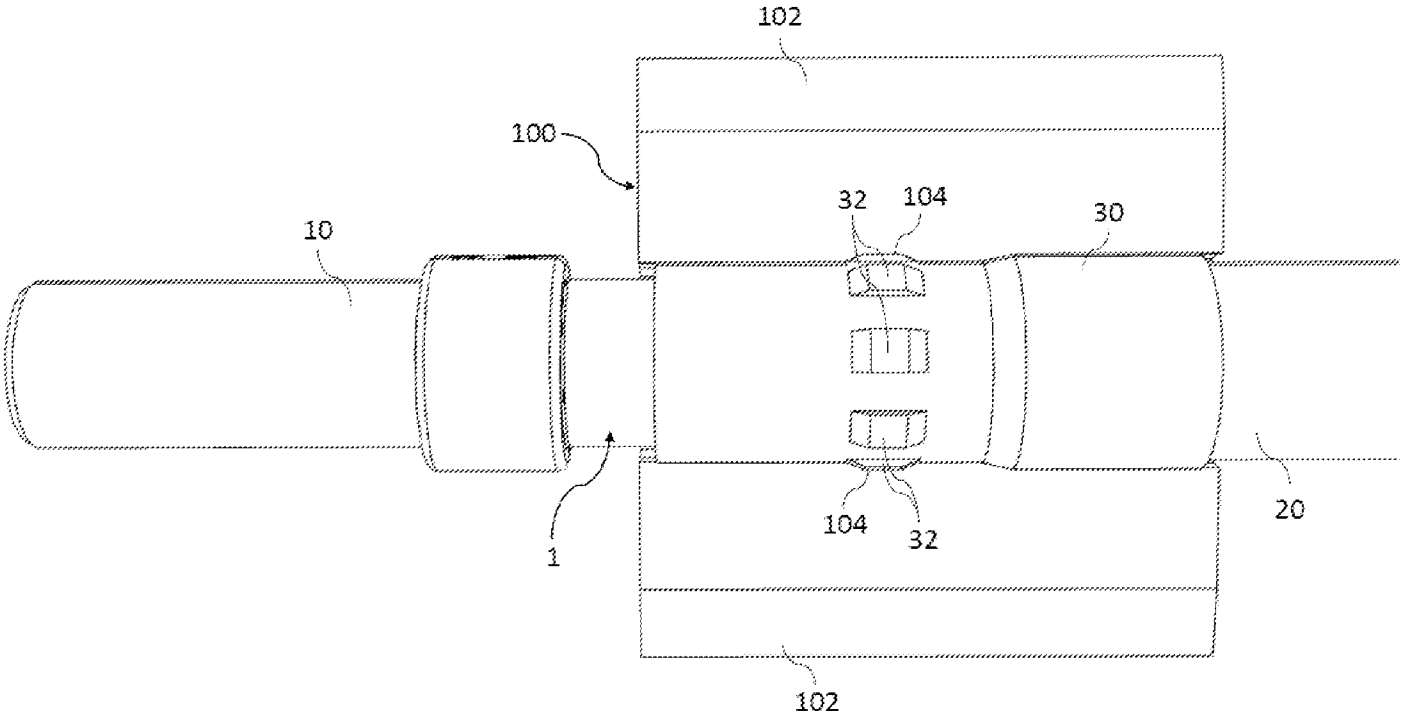
FIG. 7 is a cross-sectional view showing a plug connector in the star-type compression tool during or after the compression operation.

The dimensions of the components, in particular of housing 50 and contact 10, are predetermined. In particular, the dimensions are defined by standards and cannot be changed as desired. The creation of a third portion III with an outer diameter that corresponds to the maximum outer diameter of plug connector 1 in the assembled state can be accomplished during or after the mounting of connecting element 30 on contact 10 and/or cable 20. In particular, as shown in FIG. 6 and FIG. 7, embossed formations 32 can be created using a star-type compression tool 100. Star-type compression tool 100 is designed to bring a stamped and bent component, such as a crimp sleeve having an abutting edge or a completely closed tube, into a desired shape. Star-type compression tool 100 is made up of a plurality of compression elements 102 arranged circumferentially along the length of connecting element 30. Compression elements 102 can be synchronously moved radially toward central axis M of plug connector 1. In an open position, compression elements 102 are spaced from the central axis M and preferably spaced apart from each other. In order to perform compression, the compression elements are moved radially toward central axis M. The synchronous movement of compression elements 102 causes an even compression force or pressure to be applied to connecting element 30, thereby joining connecting element 30 to contact 10 and to cable 20. All compression elements 102 have the same regions complementary to the compressed connecting element 30. Because of this, the same pressure is applied in each region.

In addition, at least some of compression elements 102 have at least a portion of a recess 104. In the final compressed state, recesses 104 form shapes complementary to embossed formations 32 on connecting element 30. Embossed formations 32 may be created by recesses 104 during compression. In an alternative embodiment, embossed formations 32 were formed on connecting element 30 already prior to compression in star-type compression tool press 100, and recesses 104 in star-type compression tool press 100 allow the embossed formations 32 to be maintained and an even pressure force to be applied to connecting element 30.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SYMBOLS

1 plug connector
10 contact
12 free contact end
13 inner conductor
14 edge
15 outer conductor
16 sleeve
17 sleeve edge
20 cable
30 connecting element
32 embossed formation
34 guide element
36 transition section
40 plug connector assembly
50 housing
52 plug connector receptacle
54 receiving opening
56 push-through guard
58 push-through opening
100 star-type compression tool
102 compression elements
104 recess
α angle
A receptacle axis
D1 first outer diameter
D2 second outer diameter
D11 outer diameter of the contact
D22 outer diameter of the cable
D3, D4 diameter
I, II, III portions
L1-L3 lengths
M central axis
SP play

What is claimed is:

1. A plug connector for transmitting high-frequency signals, the plug connector comprising:

a cable having at least one free end;

a contact mounted on the at least one free end of the cable, the contact having a free contact end on a side facing away from the cable; and a connecting element, which is disposed between the contact and the cable, and which, in an assembled state, is fixedly connected to the contact and to the cable, the connecting element having at least a first portion with a first outer diameter on a side facing the contact and a second portion with a second outer diameter on a side facing the cable, the second outer diameter being larger than the first outer diameter, a transition section being disposed between the first portion and the second portion, the outer diameter of the connecting element increasing along the transition section, proceeding from the side facing the contact, from the first outer diameter to the second outer diameter, the first portion including at least a third portion that has, at least in some regions of the third portion, an outer diameter corresponding to the second outer diameter.

2. The plug connector as recited in claim 1, wherein an outer diameter of the contact is smaller than an outer diameter of the cable.

3. The plug connector as recited in claim 2, wherein, in the assembled state, the connecting element directly embraces the contact and the cable in the first and second portions, respectively.

4. The plug connector as recited in claim 1, wherein the connecting element includes a compression sleeve.

5. The plug connector as recited in claim 4, wherein the compression sleeve is a crimp sleeve or a compression tube.

6. The plug connector as recited in claim 1, wherein the third portion has a plurality of embossed formations formed in spaced-apart relationship on a periphery of the connecting element.

7. The plug connector as recited in claim 6, wherein the embossed formations are integral with the connecting element.

8. The plug connector as recited in claim 6, wherein guide elements are disposed at the embossed formations as transitions between the first portion and the third portion.

9. The plug connector as recited in claim 6, wherein the outer diameter of the third portion corresponds to the second outer diameter at regions of the third portion having the embossed formations, and wherein the outer diameter of the third portion corresponds to the first outer diameter at other regions of the third portion between the embossed formations.

10. The plug connector as recited in claim 1, wherein a distance between the free contact end and the third portion is smaller than a distance between the free contact end and the second portion.

11. A plug connector assembly for at least one plug connector for transmitting high-frequency signals, the plug connector assembly comprising:

at least one of the plug connector according to claim 1;

a housing having at least one plug connector receptacle for disposing the at least one plug connector in the housing, the at least one plug connector receptacle having an inner diameter corresponding to the second outer diameter of the connecting element and a length corresponding to at least a distance between the free contact end and the third portion.

12. The plug connector assembly as recited in claim 11, further comprising a push-through opening with a push-through guard, the push-through opening having a diameter corresponding to the outer diameter of the contact.

13. The plug connector according to claim 1, wherein the third portion is shorter than the first portion and is spaced apart from the second portion and from the transition section.

14. The plug connector according to claim 13, wherein the third portion has a length from 0.3 to 1 mm, and wherein the third portion is spaced from the free contact end by a distance from 12 to 18 mm.

* * * * *